US006273513B1

(12) United States Patent
Pope

(10) Patent No.: US 6,273,513 B1
(45) Date of Patent: Aug. 14, 2001

(54) APPARATUS HAVING PIVOTABLE FRAME SECTIONS WHEREIN THE APPARATUS REMOVES A FLOOR COVERING

(76) Inventor: Donald A. Pope, 118 S. Cherry St., Ocilla, GA (US) 31774

( * ) Notice: Subject to any disclaimer, the term of this patent is extended or adjusted under 35 U.S.C. 154(b) by 0 days.

(21) Appl. No.: 09/528,767

(22) Filed: Mar. 17, 2000

Related U.S. Application Data

(63) Continuation-in-part of application No. 09/354,260, filed on Jul. 15, 1999, now abandoned.
(60) Provisional application No. 60/098,816, filed on Sep. 2, 1998.

(51) Int. Cl.[7] ..... B32B 31/18; E21C 47/00
(52) U.S. Cl. ..... 299/36.1; 15/93.1; 30/170
(58) Field of Search ..... 299/36.1, 37.1; 15/93.1; 30/169, 170

(56) References Cited

U.S. PATENT DOCUMENTS

| | | | |
|---|---|---|---|
| 3,647,005 | 3/1972 | Boyd . | |
| 4,009,908 | 3/1977 | Alinder et al. . | |
| 4,088,369 | 5/1978 | Prater . | |
| 4,162,809 | 7/1979 | Anderson et al. . | |
| 4,626,033 | 12/1986 | Anderson . | |
| 4,963,224 | 10/1990 | Anderson . | |
| 4,981,548 | 1/1991 | Poll . | |
| 5,037,160 | 8/1991 | Ukai . | |
| 5,082,330 | 1/1992 | Holder . | |
| 5,197,784 | 3/1993 | Holder . | |
| 5,641,206 | 6/1997 | Craft . | |
| 5,702,161 | 12/1997 | Finney et al. . | |
| 5,713,637 | 2/1998 | Worden et al. . | |
| 5,772,284 | 6/1998 | Lindsey et al. . | |
| 5,830,313 | 11/1998 | Smith . | |
| 5,868,053 * | 2/1999 | Foltz | 30/169 X |

* cited by examiner

*Primary Examiner*—William Neuder
*Assistant Examiner*—Sunil Singh
(74) *Attorney, Agent, or Firm*—Brian D. Bellamy

(57) ABSTRACT

An apparatus for removing at least one surface layer from a floor comprises a main body frame and a rear frame section supported by rear wheels that are driven by an integrated hydraulic system including two fluid pumps. A blade tool assembly having a scraping blade is secured to the front of the main body frame and can be used for removing the floor covering. The rear frame section is attached to the main body frame by an axle assembly. The rear frame section may pivot about the longitudinal axis of the apparatus causing the wheels to adjust to debris buildup and imperfections in the floor surface such that the blade remain in constant contact with the floor covering. Further, the apparatus includes a tongue jack assembly removably attached to the front of the main body frame, and supplemental weight supporting holder are provided on each side of the main body frame for holding variable amounts of weights.

5 Claims, 7 Drawing Sheets

Fig. 8a
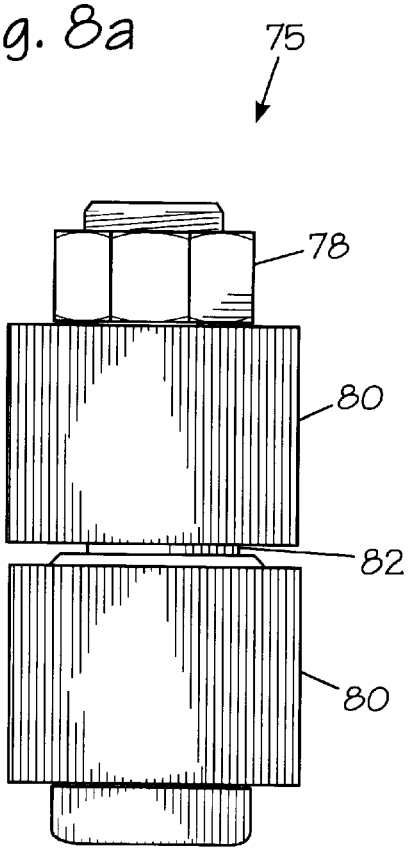
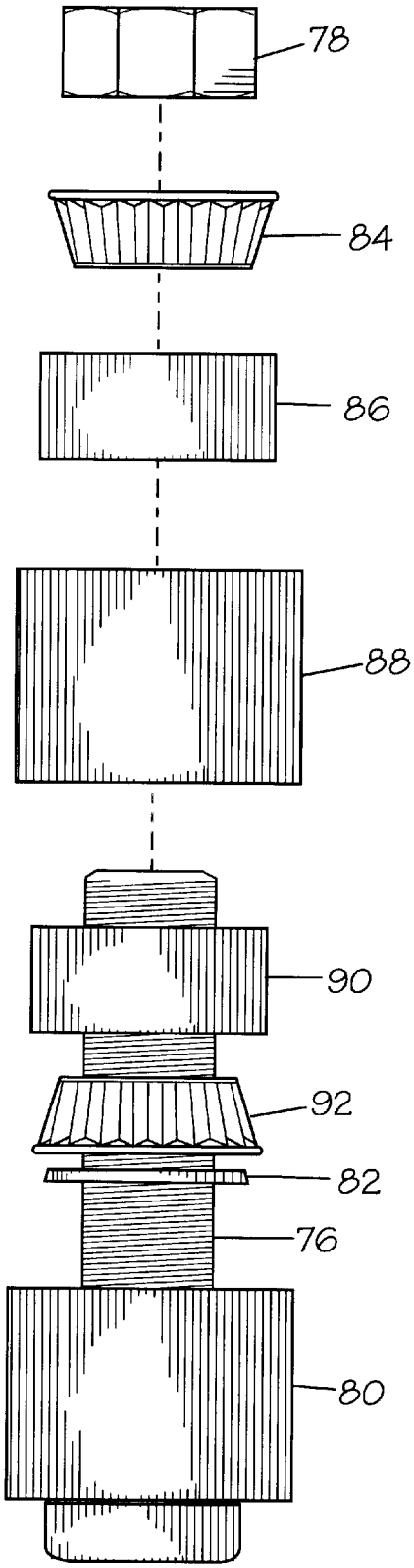
Fig. 8b

APPARATUS HAVING PIVOTABLE FRAME SECTIONS WHEREIN THE APPARATUS REMOVES A FLOOR COVERING

This application is a continuation in part application and claims the benefit of U.S. application Ser. No. 09/354,260, filed Jul. 15, 1999 and entitled APPARATUS FOR REMOVING A SURFACE LAYER FROM A FLOOR, now abandoned which claimed the benefit of U.S. Provisional Application No. 60/098,816, filed on Sep. 2, 1998.

BACKGROUND OF THE INVENTION

The present invention relates to operator mounted machines for removal and demolition of at least one layer of floor covering on a floor. The types of floor coverings that the present machine will remove include, but are not limited to, carpet, vinyl tile, ceramic tile, wood, stone, and other floor coverings that are generally found in residential and commercial buildings.

Floor coverings are often removed in buildings that are being renovated or improved. Removal of floor coverings is usually a difficult and arduous task because the floor coverings are affixed to floors such that they will remain permanently. However in order to install a new floor covering, the prior floor covering usually must be removed. Removing a floor covering by hand is not a viable option because of the difficulty of the task and the amount of areas needed to be covered. Therefore, new improved methods of removing floor covering using operator mounted machines have been invented in which the machine is mounted by an operator who sits atop the machine and controls it during use. The operator mounted type of machine is advantageous in that it is generally safer and more efficient than other known floor covering removal machines.

Contractors often price floor covering removal jobs based upon the amount of time and labor expected to complete the work required. The floor covering removal apparatus of the prior art operator mounted machines utilize a front weight bearing wheel and hydraulically operated scraping blades that lengthen the apparatus. For example, an operator mounted apparatus for removing a surface layer from a floor is disclosed in U.S. Pat. No. 5,641,206, issued May 24, 1997 to David B. Craft. The Craft patent related to an apparatus that includes a front weight bearing wheel means, front and rear weight plates, and a hydraulic means for pivoting a support plate and scraping blade. The length of a floor removal apparatus is further increased by the addition of weight plates to the front of the apparatus as taught by the Craft patent. The greater length of a machine like those being discussed increases the area needed for maneuvering the machine, and an increased maneuvering area causes the machines to miss a greater amount of floor area during the floor covering removal process, thus leading to costly inefficiencies of time and labor.

A further problem exists during the removal process when the scraping blade does not remain flush against the floor causing the scraping blade not to penetrate and remove the floor covering. The present inventor has found that a primary cause of the scraping blade jumping or slipping out of operating position is that floor covering debris often builds up in the path of a rear drive wheel of the machine. The buildup causes the rear wheel that rolls over the buildup to be raised with respect to the other rear wheel. The raised rear wheel changes the plane of the scraping blade, and the blade does not remain flush with the floor causing the blade to jump or slip when stripping floor covering. Prior art devices like that in the Craft patent do not address means for keeping the scraping blade flush with the floor surface when such debris builds up.

A similar problem is addressed by U.S. Pat. No. 5,772,284 to Lindsey et al., issued Jun. 30, 1998. The Lindsey patent relates to the use of a blade that is mounted to a bearing that changes the roll and pitch of the blade with respect to the floor. However, floor surfaces are generally flat, and it is important that any imperfections in floor surface coverings be removed. The blade in the Lindsey device adjusts to surface contours, adhesive deposits, and similar surface imperfections and may not cut through these imperfections in the floors surface covering.

Thus, while compact operator mounted machines are known for removing floor coverings, these known devices do not solve the problems discussed above.

Prior art apparatuses for removing floor covering do not eliminate the problems with scraping blade efficiency in the removal of floor coverings. When using known machines having scraping blades in fixed horizontal positions, the blades are caused to jump or slip by imperfections and by debris buildup beneath the rear wheels of an apparatus for removing floor covering. A solution to the problem of floor imperfections that teaches a rolling blade creates additional inefficiencies in that the blade may adjust to floor imperfections and contours rather than remove those imperfections. Therefore, it would be advantageous to provide an compact and maneuverable floor surface removal apparatus that would eliminate the problems with blade slippage caused by debris buildup beneath the rear wheels of the apparatus during operation.

SUMMARY OF THE INVENTION

The floor covering removal apparatus of the present invention provides more efficient removal of carpet, vinyl tile, ceramic tile, wood, stone, and other floor coverings from the floors of residential and commercial buildings. An object of the present invention is to provide a compact floor covering removal apparatus and to provide an apparatus in which the rear wheels of the machine adjust for debris buildup to assist the scraping blade in maintaining flush horizontal contact with the floor covering being removed.

In one embodiment of the invention, the apparatus comprises a machine body frame that is mounted by an operator. The body frame includes a separate rear frame section. The rear frame section includes a drive means having a right drive means and a left drive means that is driven by an integrated hydraulic pump system having a first hydraulic pump and a second hydraulic pump.

The rear frame section of the body frame is attached to the remainder of the body frame by an axle assembly having a first bearing and a second bearing separated by a spacer. The first bearing is affixed to the remainder of the body frame and the second bearing is affixed to the rear frame section. The connection of the rear frame section to the remainder of the body frame by the axle assembly provides a means for the rear frame section to pivot with respect to the main body frame. The right drive means and left drive means each includes a rear wheel that contacts the floor surface. As a wheel passes over debris on the floor surface, the rear frame section rotates with respect to the main body frame via the axle assembly. The front frame section remains in fixed horizontal relation to the floor surface and maintains the flush horizontal contact of the scraping blade with the floor surface.

To provide adequate penetration of the blade into the floor covering material, additional weight may be added. The present apparatus provides for the experienced operator to vary the pressure applied to either edge of the blade by leaning his own body weight to the left or right of the center of the machine causing the weight of the operator to be transferred to the left or right of the center. For more uniform addition of weight to assist the blade in cutting tough floor surfaces, weight plates may be added to weight supporting means on both sides of the machine body, thereby reducing the required length of the apparatus.

Further, a detachable front wheel means is provided for transporting the apparatus. When, the apparatus is in use for removing floor covering, the front wheel means may be removed to further reduce the length of the apparatus and improve the apparatus maneuverability.

BRIEF DESCRIPTION OF THE DRAWINGS

FIG. 8*a* is a top view of the axle assembly of the present invention.

FIG. 8*b* is an assembly view of the axle assembly.

DETAILED DESCRIPTION OF THE INVENTION

Figure 1:
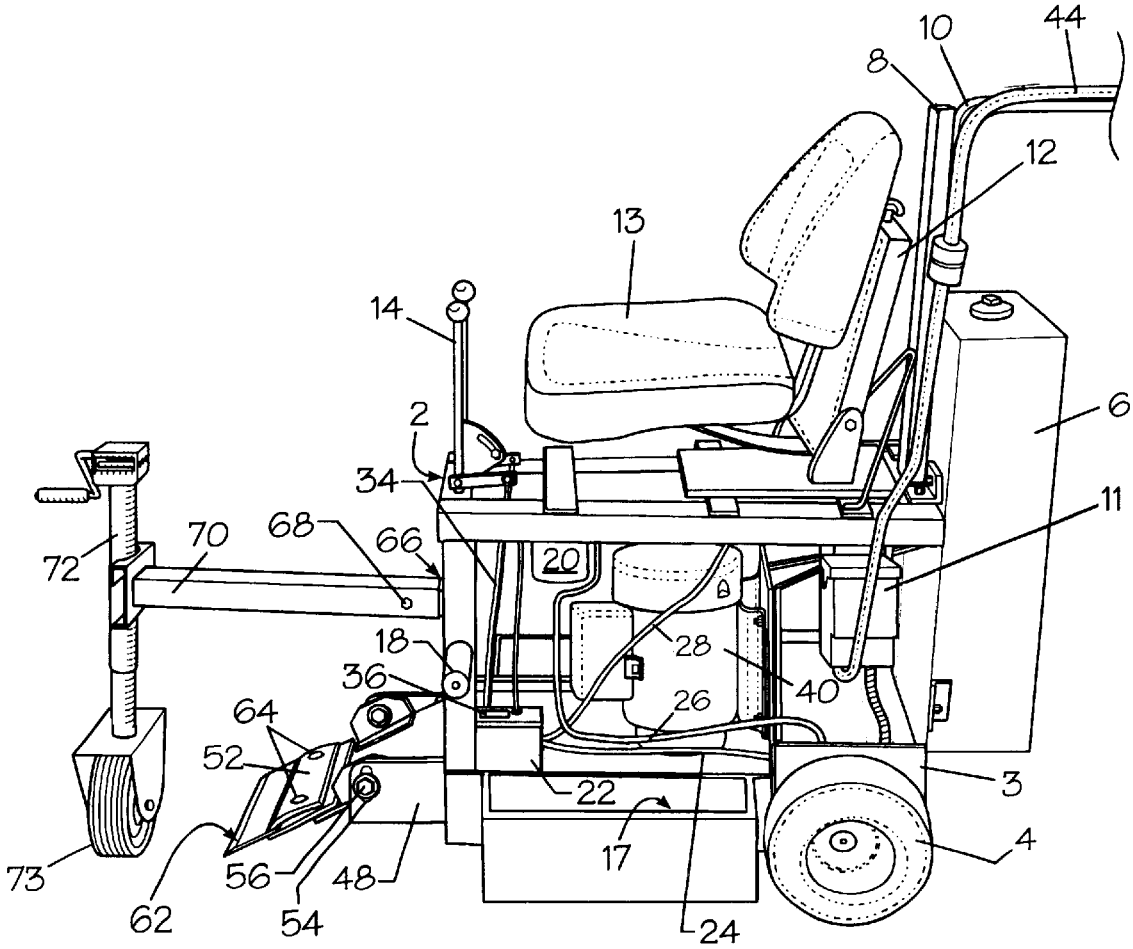
FIG. 1 is a side elevation view of the apparatus constructed in accordance with the present invention with a front wheel means attached thereto.
Figure 2:
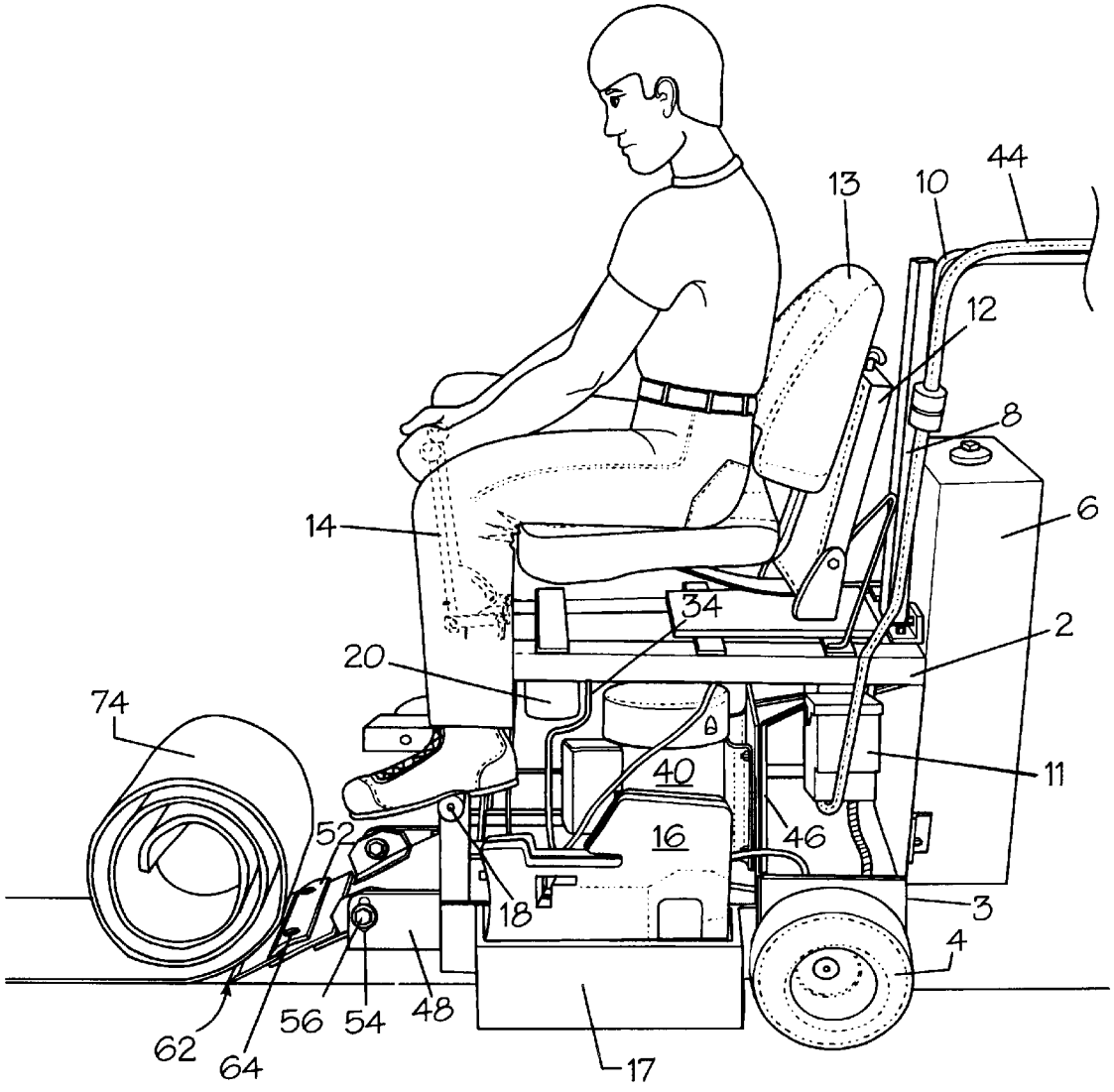
FIG. 2 is a side elevation view of the apparatus of the present invention in operation with the front wheel means detached and having weights added thereto.
Figure 3:
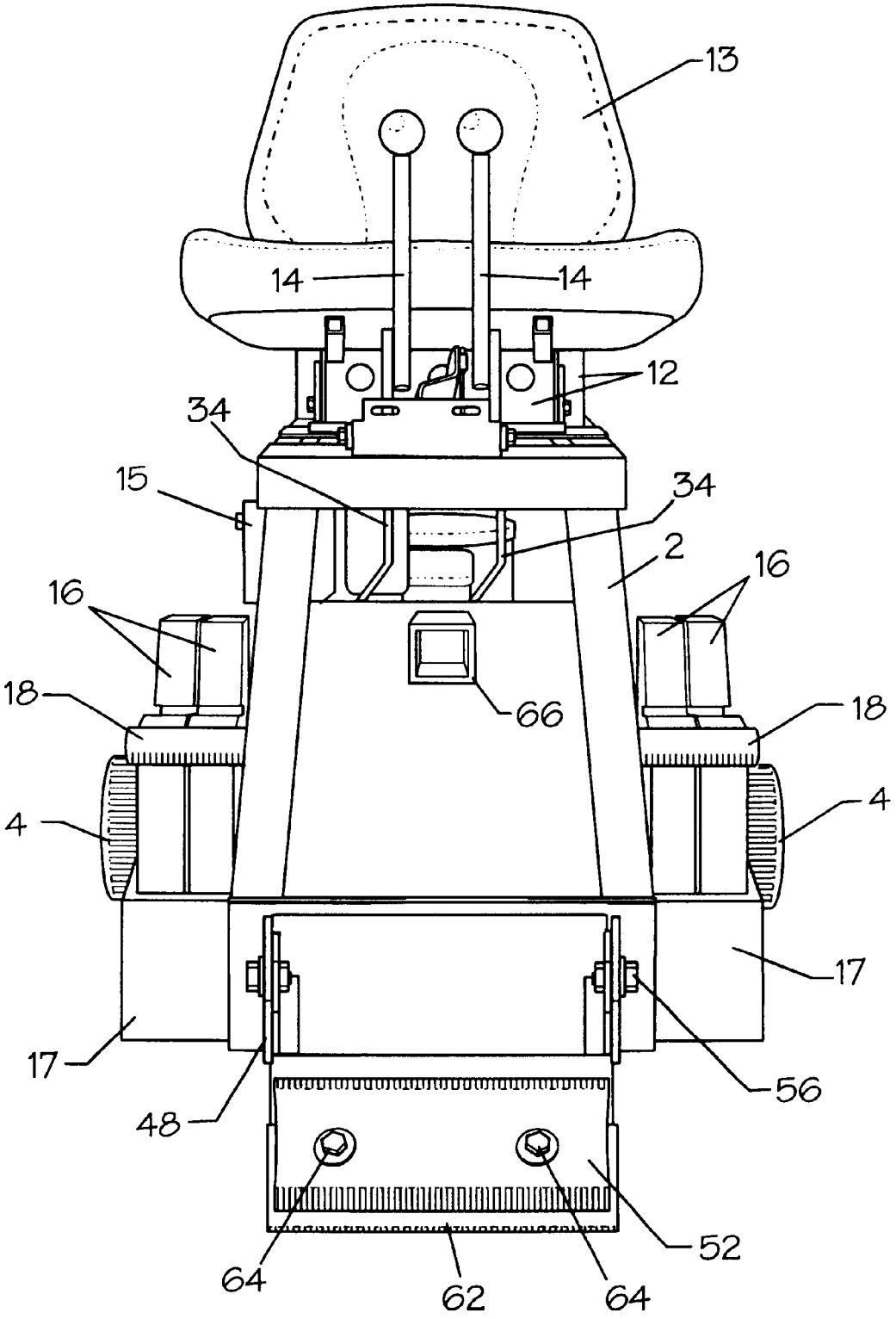
FIG. 3 is a front view of the apparatus of FIG. 2.
Figure 4:
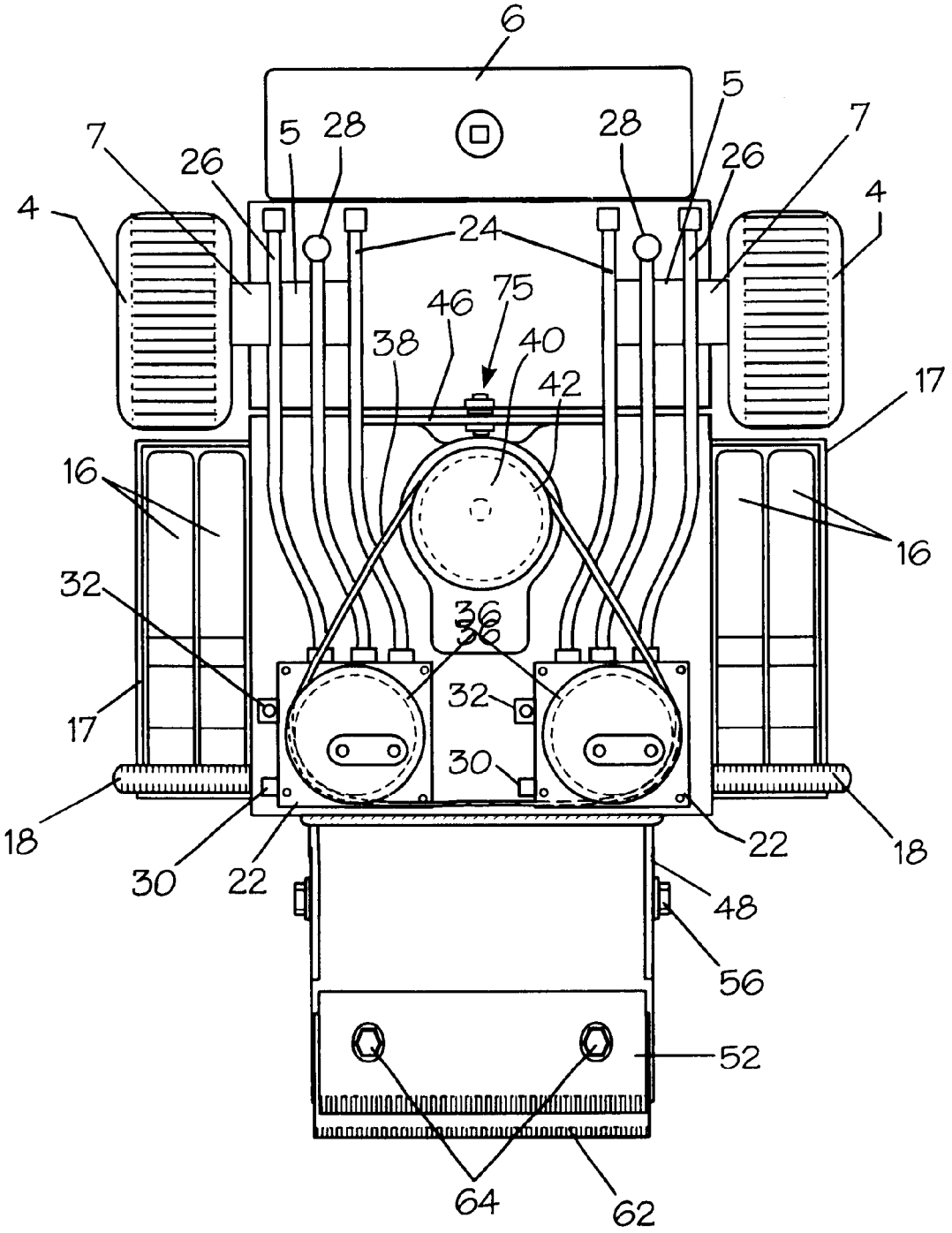
FIG. 4 is a cut away top view of the apparatus of FIG. 2 that shows in detail the configuration of the integrated hydraulic pump system and the rear frame section.
Figure 5:
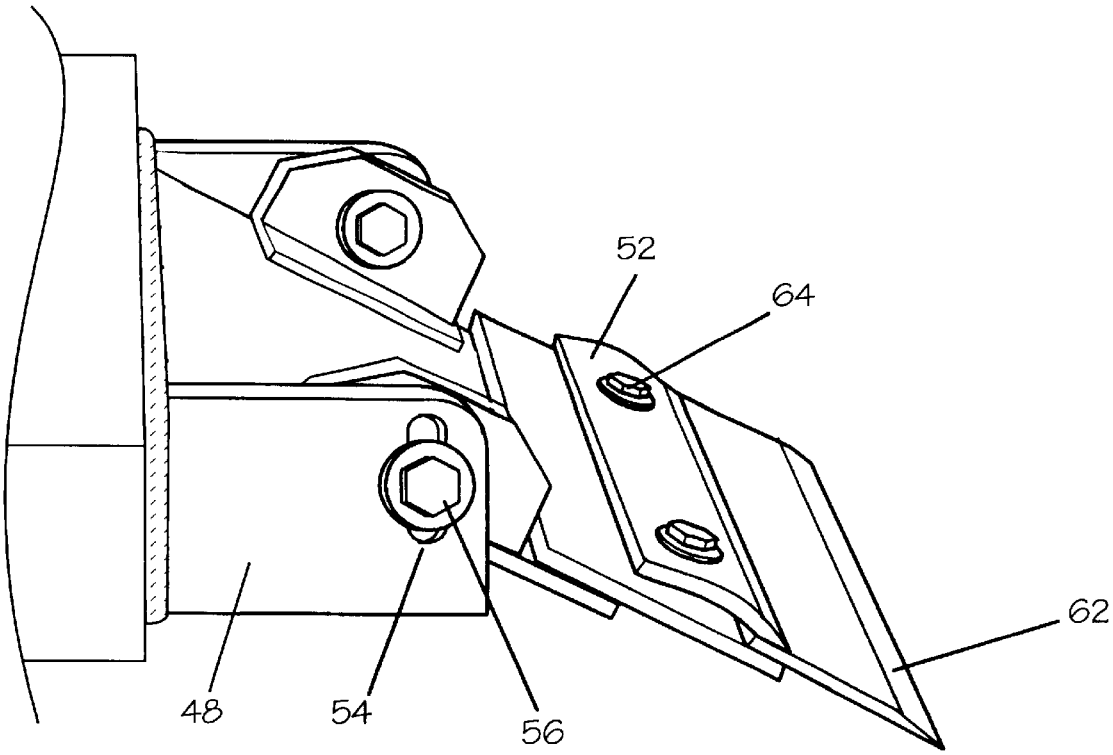
FIG. 5 is a side elevation view of the blade tool assembly constructed in accordance with present invention.

Referring to the drawings in detail, the apparatus comprises a main body frame 2 and a rear frame section 3 having left and right rear wheels 4 that support the rear frame section 3. The right and left drive means 4 each comprise at least one wheel attached via independent axle means 7 to at least one independently operable hydraulic drive motor 5 contained within the rear frame section 3. Hydraulic fluids flowing from hydraulic pumps 22 provide power to each of the independent drive motors 5 to provide a drive means to drive each wheel 4 separately in rearward or forward directions. The present apparatus provides a compact and highly mobile apparatus for removing floor covering 74 that uses an integrated dual hydraulic pump system that separately drives the wheels of the independent right and left rear drive means or wheel 4. The apparatus may be piloted in very tight settings, and the mobility of the apparatus makes it much easier to use than the prior art floor covering removers of the type disclosed herein.

In the preferred embodiment, the rear frame section 3 includes a rear end on which a hydraulic fluid container 6 is attached for providing a source of fluid to the integrated hydraulics system. Further, in this embodiment an electric motor 40 is utilized to provide power to the hydraulic system, thus a power cord holder 8 and power cord rotator 10 are also mounted on the rear end of the rear frame section 3 and a control panel 11 is provided for operating the motor 40.

The comfort of the machine operator is provided for by a spring cushioned seat mount 12 on the top of the body frame 2 having a seat 13 mounted thereon and feet rests 18 affixed to the body frame 2 for the operator to rest his feet on. While seated on the seat 13 the operator controls levers 14 to independently control the rearward and forward direction of the rear drive means 4 of the apparatus. Thereby, the user may begin use of the apparatus to remove floor covering 74 from a floor by using start switch 15 to initiate the provision of electric or other power to the apparatus.

Depending upon the nature of the floor covering 74, supplemental weight may be needed to add the additional force needed to cause the scraping blade 62 to penetrate the floor covering 74. In prior art machines, weight is added at the front or rear of the machine to control the penetration of the blade 62. However, in the present apparatus, weight plates 16 may be added to weight holders 17 that are integrally attached to the right and left sides of the body frame 2. These side positioned weight holders 17 contribute to reducing the length of apparatus and also help provide for optimum weight and balance of the machine.

The present apparatus includes an integrated hydraulic pump system for driving the rear wheels 4. Hydraulic fluid filtered by a fluid filter 20 is provided to the hydraulic system from the fluid container 6 to a pair of hydraulic pumps 22 consisting of a first hydraulic pump and a second hydraulic pump. Each of the hydraulic pumps 22 of the present invention are integrated into the body frame 2 of the apparatus. The use of two hydraulic pumps 22 reduces stress on each hydraulic pump 22 and provides simple independent control of each drive wheel 4 to assist in maneuvering the apparatus. Each of the hydraulic pumps 22 connect to a fluid forward line 24, a fluid reverse line 26, and an overflow line 28. Each of these lines 24, 26, and 28 connects to the rear hydraulic axle 7. The fluid forward line 24 provides hydraulic fluid to the hydraulic axle 7 for driving the wheels 4 in the forward direction. The fluid reverse line 26 provides hydraulic fluid to the hydraulic axle 7 for driving the wheels 4 in the rearward direction. The overflow line 28 provides a re-feed mechanism for fluid overflow from the fluid container 6.

The hydraulic pumps 22 include a valve plug 30 and a control plug 32. The control plug 32 is connected to control links 34 which connect to the control levers 14 that the user uses to control the direction hydraulic fluids driving the wheels 4. The valve plug 30 may be loosened to release the hydraulic fluid pressure within the system and provide a means to allow the drive means 4 to rotate and move freely upon exerting force upon the body frame 2. Free movement of the wheels 4 provides important flexibility in rolling the apparatus short distances.

The hydraulic pumps 22 connect to a motor 40 via pulleys 36 and 42 on both the hydraulic pumps 22 and on the motor 40. A belt 38 is placed on the pump pulleys 36 and the motor pulleys 42 to drive the hydraulic pumps 22. The motor 40 is powered by electrical power provided by a power cord 44. The power cord 44 connects to the motor control box and runs upward on the power cord holder 8 and is held by the power cord rotator 10 such that the power cord 44 does not interfere with the operation of the device. The motor 40 mounts to the body frame 2 via a reinforced motor mount 46.

The scraping blade 62 for removing floor covering material 74 is attached to the front of the body frame 2 by a blade assembly. The blade assembly comprises several features. First, a blade holder frame 48 is connected to the body frame 2. The blade holder frame 48 includes a flange on each side thereof having slots 54 that a blade holder 52 is attached to by bolts 56 and that permit the blade holder 52 to slide upward and downward within the slots 54 for adjusting the pitch of the blade holder 52. The blade 62 fits within the blade holder 52 and is clamped down using a pair of bolts 64. The top side of the blade holder 52 is slightly convex to strengthen the hold of the blade holder 52 on the blade 62 and also to allow the use of a wider variety of blade types.

A tongue jack sleeve 66 is provided at the front of the body frame 2 such that a tongue jack assembly 72 may be adapted to be attached to the body frame 2. The tongue jack assembly 72 has an extension shaft 70 that is attached to the jack sleeve 66 using a pin 68. The attachment of a tongue jack assembly 72 is helpful in the transport of the apparatus in that it provides a front weight bearing wheel 73 as a supportive means for rolling the apparatus. However, the tongue jack assembly 72 is removable so that it is not used during the operation of the apparatus. Removing the tongue jack assembly 72, reduces the overall length of the apparatus and increases its mobility, which assists in the efficient removal of floor covering 74. Likewise, the removable tongue jack 72 abrogates the need for a permanent front weight bearing wheel affixed to the body frame of the machine, thus further reducing the length of the operable machine.

Figure 6:
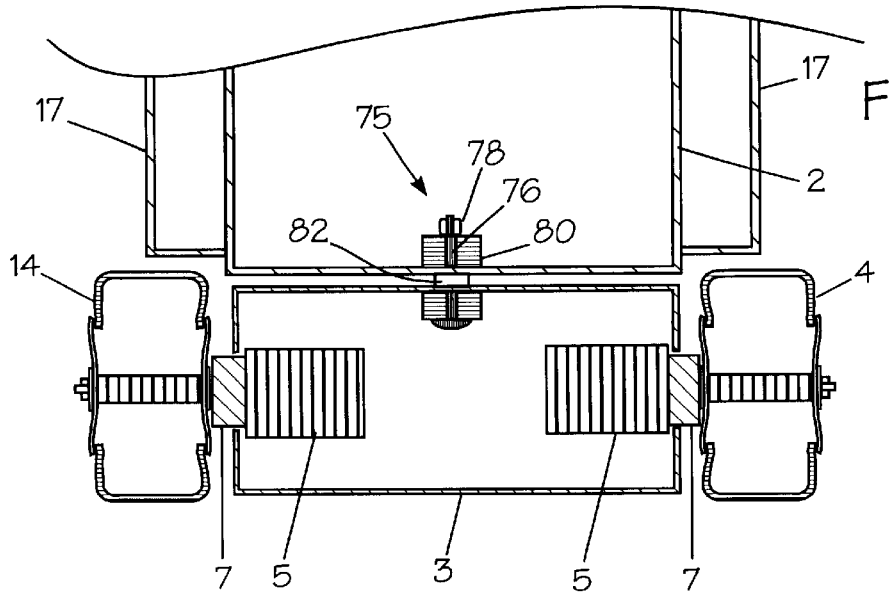
FIG. 6 is a sectional cut away top view of the floating rear frame section constructed in accordance with the present invention.
Figure 7A:
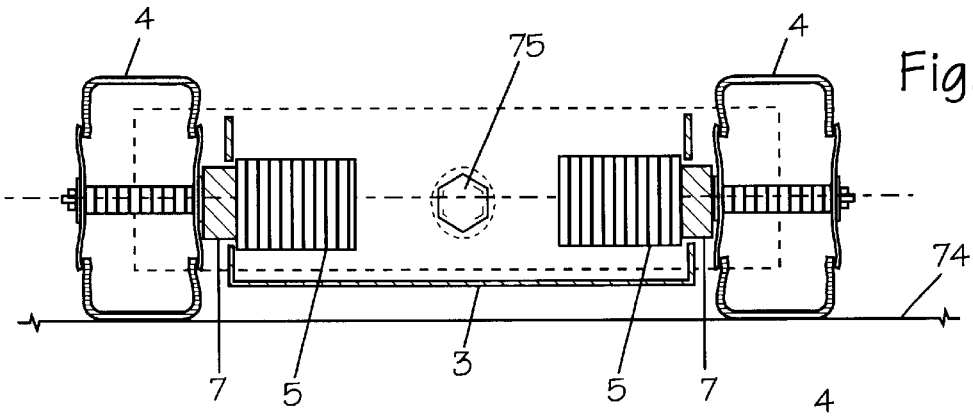
FIG. 7*a* is a sectional cut away rear view of the apparatus on a level floor surface.
Figure 7B:
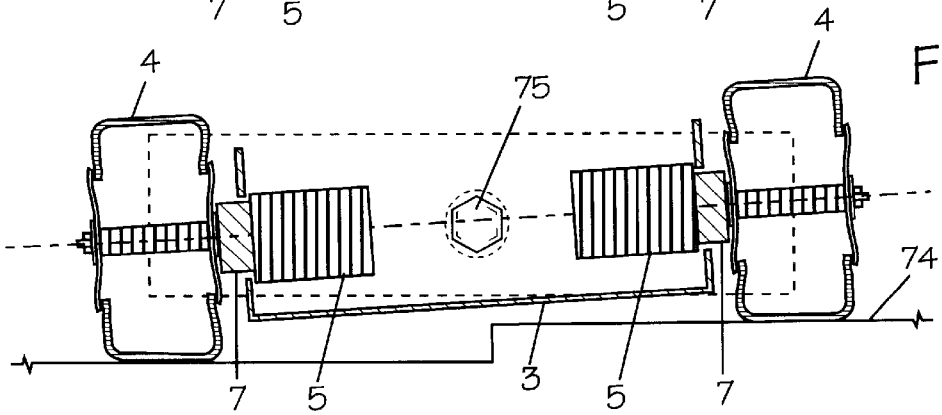
FIG. 7*b* is a sectional cut away rear view of the apparatus on an uneven floor surface.

As shown in FIG. 6, the rear frame section 3 is pivotally connected to the main body frame 2 by an axle assembly 75. The axle assembly 75 includes a pair of bearing assemblies 80. A first bearing assembly 80 is affixed to the main body frame 2, and a second bearing assembly 80 is affixed to the rear frame section 3. The bearing assemblies 80 are affixed at about the center of the width of the machine along a longitudinal line parallel to length of the machine. Thereby, the rear frame section 3 may pivot about the longitudinal axis of the machine. FIG. 7*a* illustrates the condition of the apparatus when the apparatus is operating on a flat floor surface without the rear wheels 4 being affected by the buildup of debris. FIG. 7*b* illustrates the condition of the apparatus when the right rear wheel 4 is affected by debris. As shown in FIG. 7*b,* the rear frame section 3 will pivot about the axle assembly 75 when a wheel 4 is affected by debris buildup. Thereby, the main body frame 2 will remain unaffected by the debris buildup.

The primary objective of the novel pivoting rear frame section 3 is to maintain the blade 62 under the floor surface 74 being removed. After gaining substantial experience during experimentation with the present invention, the inventor discovered a surprising benefit of the novel rear frame section 3 pivoting about the axle assembly 75. The rear pivot enables the experienced operator to vary the pressure applied to either edge of the blade 62 by the operator leaning his own weight to the left or right of the center of the body frame 2. On a standard machine, the rear wheels of the machine are fixed with respect to the horizontal plane of the frame 2 and act to stabilize the machine and prevent manipulation of the blade 62 by the weight of the operator shifting. However, when the rear frame section 3 pivots, the operator may manipulate the body frame 2 causing manipulation of the blade 62 to assist in maintaining the blade 62 beneath the floor surface 74. Obviously, if the blade 62 were also allowed to pivot horizontally this beneficial effect of the pivoting rear frame section 3 would be eliminated.

FIGS. 8*a* and 8*b* illustrate the axle assembly 75 in greater detail. The axle assembly 75 includes a bolt 76 that provides a shaft for the assembly. The axle assembly 75 is held together by a nut 78 that screws onto the bolt 76. The bolt retains a pair of bearing assemblies 80 separated by a spacer 82.

Each bearing assembly 80 comprises a bearing 84 that is contained within a retaining ring 86 when assembled. The retaining ring 86 and bearing 84 are each contained within a bearing cylinder 88. Further, the bearing assembly 80 includes a second retaining ring 90 and bearing 92 contained within cylinder 88 opposite said first retaining ring 90 and bearing 84. The components described combine to form a bearing assembly 80.

While preferred embodiments of the invention have been shown and described, it will be apparent to those skilled in this art that various modification may be made in these embodiments without departing from the spirit of the present invention. For that reason, the scope of the invention is set forth in the following claims.

I claim:

1. An apparatus for removing for covering from a floor surface comprising:

a frame mountable by a machine operator during operation having a main body section having a front end and a rear frame section supported by wheels;

a blade tool attached to the front end of the main body section;

a drive means attached to the frame for moving the frame and blade tool over the floor surface;

an axle assembly attaching the main body section to the rear frame section;

a means for providing a first transport position in which said blade tool is elevated from the floor surface, and a second operating position in which said blade tool contacts the floor covering being removed.

2. The apparatus of claim 1 wherein said frame include a longitudinal axis and said axle assembly includes a first bearing assembly attached to said main body section and a second bearing assembly attached to said rear frame section such that said rear frame section pivots about the longitudinal axis of said frame.

3. The apparatus of claim 1 wherein said means for providing a first transport position in which said blade tool is elevated from the floor surface and a second operating position in which said blade tool contacts the floor covering being removed includes:

a tongue jack sleeve;

a tongue jack assembly having a weight bearing wheel;

an extension shaft attached to the tongue jack assembly;

a means for attaching the extension shaft to the tongue jack sleeve.

4. An apparatus for removing floor covering from a floor surface comprising:

a frame mountable by a machine operator during operation having a main body section having a front end, a right side, a left side, and a longitudinal axis, and a rear frame section supported by wheels;

a blade tool attached to the front end of the main body section;

a drive means attached to the frame for moving the frame and blade tool over the floor surface;

supplemental weight supporting means on the right side of the main body section and the left side of the main body section for holding variable amounts of weights;

an axle assembly attaching the main body section to the rear frame section such that the rear frame section pivots about the longitudinal axis of the main body section;

a means for providing a first transport position in which said blade tool is elevated from the floor surface, and a second operating position in which said blade tool contacts the floor covering being removed.

5. The apparatus of claim 4 wherein said axle assembly includes a first bearing assembly attached to said main body section and a second bearing assembly attached to said rear frame section.

* * * * *